US008944115B2

(12) United States Patent
Beauduin

(10) Patent No.: US 8,944,115 B2
(45) Date of Patent: Feb. 3, 2015

(54) METHOD AND DEVICE FOR THE MANUFACTURING OF FABRICS WITH AT LEAST TWO DIFFERENT PILE HEIGHTS IN A SAME PILE ROW

(75) Inventor: Charles Beauduin, Halle (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 13/522,029

(22) PCT Filed: Jan. 11, 2011

(86) PCT No.: PCT/IB2011/000029

§ 371 (c)(1), (2), (4) Date: Jul. 13, 2012

(87) PCT Pub. No.: WO2011/086449

PCT Pub. Date: Jul. 21, 2011

(65) Prior Publication Data

US 2013/0019987 A1 Jan. 24, 2013

(30) Foreign Application Priority Data

Jan. 15, 2010 (BE) ..... 2010/0023

(51) Int. Cl.

| | |
|---|---|
| ***D03D 39/00*** | (2006.01) |
| ***D03D 39/16*** | (2006.01) |
| ***D03D 27/06*** | (2006.01) |
| ***D03D 39/18*** | (2006.01) |
| ***D03D 39/20*** | (2006.01) |
| ***D03D 39/24*** | (2006.01) |
| ***D03D 49/04*** | (2006.01) |
| *D03D 23/00* | (2006.01) |

(52) U.S. Cl.

CPC ..... *D03D 27/06* (2013.01); *D03D 39/00* (2013.01); *D03D 39/16* (2013.01); *D03D 39/18* (2013.01); *D03D 39/20* (2013.01); *D03D 39/24* (2013.01); *D03D 49/04* (2013.01)

USPC ..... 139/21; 139/11; 139/392

(58) Field of Classification Search

USPC ..... 139/7 A, 7 R, 7 D, 7 F, 21, 116.5, 391

See application file for complete search history.

(56) References Cited

U.S. PATENT DOCUMENTS

| | | | | | |
|---|---|---|---|---|---|
| 2,225,452 | A | * | 12/1940 | Jacobsen | 139/21 |
| 2,430,559 | A | * | 11/1947 | Dacey | 139/403 |
| 2,477,248 | A | * | 7/1949 | Harding | 139/39 |
| 2,477,249 | A | * | 7/1949 | Harding | 139/39 |
| 2,553,303 | A | * | 5/1951 | Crawford | 139/39 |

(Continued)

FOREIGN PATENT DOCUMENTS

| | | | |
|---|---|---|---|
| EP | 1347087 | A2 | 9/2003 |
| EP | 2135983 | A1 | 12/2009 |
| GB | 346107 | A | 4/1931 |

*Primary Examiner* — Bobby Muromoto, Jr.

(74) *Attorney, Agent, or Firm* — James Creighton Wray

(57) ABSTRACT

A method weaves pile fabrics with at least two different pile heights (a, b) in the same pile row, wherein the fabrics have weft threads, ground warp threads and pile-warp threads (1, 2), wherein these pile-warp threads are interlaced in the fabric, according to a pattern, in a figure-forming manner or are inwoven in a non-figure-forming manner, and which, when they are figure-forming, form pile with a well-defined pile height. The method includes a first set of pile warp threads, under light strain and at least a second set of pile warp threads under a higher strain. A device for manufacturing such fabrics is described.

10 Claims, 2 Drawing Sheets

(56) References Cited

U.S. PATENT DOCUMENTS

| | | | | | |
|---|---|---|---|---|---|
| 2,573,841 | A * | 11/1951 | Groat | 139/39 |
| 2,650,621 | A * | 9/1953 | Crawford | 139/39 |
| 2,674,271 | A * | 4/1954 | Rice | 139/44 |
| 2,709,461 | A * | 5/1955 | Groat | 139/403 |
| 2,714,405 | A * | 8/1955 | Hoeselbarth | 139/403 |
| 3,204,669 | A | 9/1965 | Valentine et al. | |
| 6,817,383 | B2 * | 11/2004 | Debaes et al. | 139/21 |
| 6,837,274 | B2 * | 1/2005 | Debaes et al. | 139/21 |
| 7,111,647 | B2 * | 9/2006 | Debaes | 139/21 |
| 7,487,804 | B2 * | 2/2009 | Bruynoghe | 139/21 |
| 2003/0226613 | A1 * | 12/2003 | Debaes et al. | 139/408 |
| 2004/0221915 | A1 * | 11/2004 | Debaes et al. | 139/409 |
| 2005/0183787 | A1 * | 8/2005 | Debaes | 139/11 |
| 2007/0235102 | A1 * | 10/2007 | Bruynoghe | 139/21 |
| 2008/0053557 | A1 * | 3/2008 | Debaes | 139/404 |
| 2008/0115852 | A1 * | 5/2008 | Debaes | 139/21 |

* cited by examiner

METHOD AND DEVICE FOR THE MANUFACTURING OF FABRICS WITH AT LEAST TWO DIFFERENT PILE HEIGHTS IN A SAME PILE ROW

This application claims the benefit of Belgian Application No. BE-2010/0023 filed Jan. 15, 2010 and PCT/IB2011/000029 filed Jan. 11, 2011, International Publication Number WO 2011/086449, which are hereby incorporated by reference in their entirety as if fully set forth herein.

The present invention relates, on the one hand, to a method for weaving pile fabrics with at least two different pile heights in the same pile row, wherein the fabrics comprise weft threads, ground warp threads and pile-warp threads, wherein these pile-warp threads are interlaced in the fabric, according to a pattern, in a figure-forming manner or are inwoven in a non-figure-forming manner, and which, when they are figure-forming, form pile with a well-defined pile height. On the other hand, the present invention relates to a device for manufacturing such fabrics.

There is clear evidence of a strong trend to realize pile fabrics with different structures within the same fabric. For instance, EP 1 347 087 describes a method and a device for manufacturing, in a double-face weaving technique, fabrics containing a large variety in structure. It is thus possible to make virtually unlimited combinations of cut pile with loops and with figure-forming warp threads (yarns) which on the pile side float over one or more wefts prior to being interlaced (so-called 'flat weave').

British patent application GB 346107 describes a method which, with the double-face weaving technique, allows pile of different height to be inserted into a fabric by making pile threads (yarns) for the longer pile float over a number of wefts on the pile side and then interlacing them over a weft on the pile side prior to moving them to the other ground fabric, so that after the pile has been cut through, this latter pile, with a limited force by a scratching operation on the carpet fabric, can be released from this weft on the pile side, whereby a longer pile yarn is formed than is the case with normal pile fabric formation. Such a technique, in view of the considerable number of wefts over which it is necessary to interlace, can only deliver high pile in a limited density. Moreover, a special scratching operation is necessary.

EP 2 135 983 in turn describes how, on a double-face weaving machine, the pile height can be changed cycle after cycle by making the cutting knife operate at a different height, whereby, in both fabrics in the double-face fabric, complementary pile height differences arise: where in the bottommost fabric a row with short pile is realized, in the topmost fabric a pile row with longer pile is found. For this there is provision to adjust the cutting knife in its holder or to change between cutting knives at different heights in the cutting region. The solution described in EP 2 135 983 allows per cutting movement only one pile height over the full width of the fabric, so that the design options with height differences are here rather limited.

American patent publication U.S. Pat. No. 3,204,669 describes a double-face weaving machine for the double-face weaving of a top and bottom fabric comprising at least two different pile heights. This publication describes the use of removable wefts for the making of pile fabrics with different pile heights in one fabric. The removal of the wefts demands an additional step, which drives up the cost price by virtue of the fact that it either has to be performed either by an operator or by means of additional machine components, which, moreover, add to the complexity and adversely affect the weaving efficiency. Nor can the higher pile height be chosen totally freely, since, in relation to the smallest pile height, increases are only possible either according to an odd multiple of the lancet height or according to the distance between the wefts determined by the pick density.

The object of the present invention is to provide a method which allows fabrics with cut pile and/or loop pile in different pile heights to be realized on single-face and double-face weaving devices, with a free choice in terms of position and pile height of the zones with differing pile height, and this without the drawbacks of the prior art.

A further object of the present invention is to provide a device which permits such a method.

The object of the invention is achieved by providing a method for weaving pile fabrics with at least two different pile heights in the same pile row, wherein the fabrics comprise weft threads, ground warp threads and pile-warp threads, wherein these pile-warp threads are interlaced in the fabric, according to a pattern, in a figure-forming manner or are inwoven in a non-figure-forming manner, and which, when they are figure-forming, form pile with a well-defined pile height, wherein a first set of pile-warp threads is inserted in such a way that these move virtually without strain, or under light strain, onward into the just formed fabric, and wherein at least a second set of pile-warp threads is inserted in such a way that, in relation to the first set of pile-warp threads, they move with a higher strain onward into the just formed fabric. For all types of machine, this is the piece of fabric which has been formed in a limited number of weaving cycles before the current weaving cycles; for double-face weaving, this is the double-face fabric which extends up to the place where this is cut in two; in loop-pile and cut-loop weaving, this is the just formed piece of fabric which extends to where the loops present in this piece leave the loop-height determining means (lancets). In rod weaving, it is the fabric up to the place at which the rod over which the pile was formed is withdrawn.

Strain is a dimensionless number which represents the ratio of the increase in length of a specific object under load in relation to the unloaded length, or $(L-L_0)/L_0$. The height difference is determined by the elastic portion of the strain of the pile-warp threads. This is that portion of the strain which is abolished upon the loss of the tension associated with the cutting through (or upon leaving the loop height determining means, or upon withdrawal of the rod). The insertion of these pile-warp threads under strain thus merely delivers a height difference as regards the elastic portion of this strain.

It is evident that, within the scope of this patent application, the method can be expanded by the insertion of a third, fourth, fifth, sixth, seventh, eighth, etc. set of pile-warp threads. Each of these following sets of pile-warp threads can be inserted in such a way that, in relation to the first set of pile-warp threads, they move with a higher strain onward into the just formed fabric, but that, in relation to the other sets of pile-warp threads, they move with a higher or lower strain onward into the just formed fabric. In this way, fabrics with large varieties can be formed.

In a preferred method of the invention, in the first and at least second set of pile-warp threads, pile-warp threads with virtually the same characteristics are found.

In another preferred method according to the invention, the pile-warp threads of the at least second set of pile-warp threads have other characteristics than the pile-warp threads of the first set of pile-warp threads. Moreover, the choice can be made to have pile-warp threads with different characteristics also within a set, in order, for example, to obtain a desired stripe effect in the warp direction.

According to a particular method according to the invention, the at least second set of pile-warp threads, in relation to the first set of pile-warp threads, is fed with a higher strain to the fabric to be formed. For this purpose, in a preferred method, the at least second set of pile-warp threads is fed to the fabric to be formed by means of a feed control device for pile-warp threads.

In a more particular method according to the invention, the pile fabrics are woven on a single-face weaving machine. The single-face weaving machine is in particular of the rod weaving machine type, wherein the pile-warp threads are alternately interlaced in the fabric, according to a pattern, in a figure-forming manner over a rod and inwoven in a non-figure-forming manner, and which, when they are figure-forming, form pile with a well-defined pile height, and wherein the first set of pile-warp threads, in figuring application, is designed to realize a first pile height following the withdrawal of the rod, and wherein at least a second set of pile-warp threads, in figuring application, is designed to realize a second pile height following the withdrawal of the rod.

In another particular method according to the invention, a bottommost and a topmost pile fabric are woven according to a double-face weaving method, wherein the pile-warp threads are interlaced in the fabric, according to a pattern, in a figure-forming manner or are inwoven in a non-figure-forming manner, and which, when they are figure-forming, form pile with a well-defined pile height, and wherein the first set of pile-warp threads, in figuring application, is interlaced alternately in the bottommost and topmost pile fabric and is designed to, after having been cut through, realize in each pile fabric a first pile height, and wherein the at least one second set of pile-warp threads, in figuring application, is interlaced alternately in the bottommost and topmost pile fabric and is designed to, after having been cut through, realize in each pile fabric a second pile height.

It is evident that, within the scope of this patent application, the method can be expanded by the insertion of a third, fourth, fifth, sixth, seventh, eighth, etc. set of pile-warp threads, which respectively in figuring application is interlaced alternately in the bottommost and topmost pile fabric and which is designed to, after having been cut through, realize a third, fourth, fifth, sixth, seventh, eighth, etc. pile height in both pile fabrics and to thereby realize yet more effects in both pile fabrics.

According to a particularly advantageous embodiment of the method according to the invention, the pile fabrics are woven on a double-face weaving machine provided with a lancet device having one or more lancets, and all figure-forming pile-warp threads are cut through at a channel in the lancets.

The present invention likewise relates to a weaving machine for the weaving of pile fabrics comprising at least two different pile heights in the same pile row, wherein the said fabrics comprise weft threads, ground warp threads and pile-warp threads, and wherein these pile-warp threads are interlaced in the fabric, according to a pattern, in a figure-forming manner or are inwoven in a non-figure-forming manner, and which, when they are figure-forming, form pile with a well-defined pile height, wherein the weaving machine comprises first means designed to introduce a first set of pile-warp threads in such a way that they will move, virtually without strain or under slight strain, onward into the fabric to be formed, and wherein the weaving machine further comprises at least second means, designed to introduce at least a second set of pile-warp threads in such a way that, in relation to the first set of pile-warp threads, they will move with a higher strain onward into the fabric to be formed.

The said weaving machine is preferably a double-face weaving machine for the double-face weaving of a top and bottom fabric comprising at least two different pile heights in the same pile row.

The said double-face weaving machine is especially suitable for the double-face weaving of a top and bottom fabric comprising at least two different pile heights in the same pile row, wherein the said fabrics comprise weft threads, ground warp threads and pile-warp threads, and wherein these pile-warp threads are interlaced in the fabric according to the pattern, in a figure-forming manner or are inwoven in a non-figure-forming manner, and which, when they are figure-forming, form pile with a well-defined pile height, wherein the weaving machine comprises first means in order to introduce a first set of pile-warp threads in such a way that these move, virtually without strain or under slight strain, onward into the just formed fabric, and which, in figuring application, is interlaced alternately in the bottommost and topmost pile fabric, and which is designed to, after having been cut through, realize a first pile height in both pile fabrics, and wherein the weaving machine further comprises at least second means in order to introduce at least a second set of pile-warp threads in such a way that, in relation to the first set of pile-warp threads, they move with a higher strain onward into the just formed fabric, and which, in figuring application, is interlaced alternately in the bottommost and topmost pile fabric, and which is designed to, after having been cut through, realize a second pile height in both pile fabrics.

In addition, the present invention relates to a lancet device for a double-face weaving machine comprising a cutting device provided with a cutting knife for cutting through a double-face fabric and one or more lancets, wherein a lancet at one end is designed to be installed in a lancet holder and at the other end is provided with a lancet tip, wherein the lancet tip comprises a channel through which the cutting knife is at least partially movable. The channel is formed in a direction towards the end which is designed to be installed in a lancet holder. The channel is more especially formed by two planes which extend from the outer side and taper towards each other in the direction towards the end which is designed to be installed in a lancet holder, the two planes intersecting approximately at the centreline of the lancet.

The method according to the present invention is explained more fully below and a number of preferred methods and devices are described in detail by way of example. The sole purpose thereof is to further illustrate the general principles and the said characteristics and advantages of the invention by means of a number of concrete examples. It should hopefully be clear that nothing in this description can thus be interpreted as a limitation of the scope of the patent rights claimed in the claims, nor as a limitation of the field of application of the present invention.

In the following description, reference is made by way of reference numerals to the hereto appended drawings, in which:

DETAILED DESCRIPTION

Figure 1:
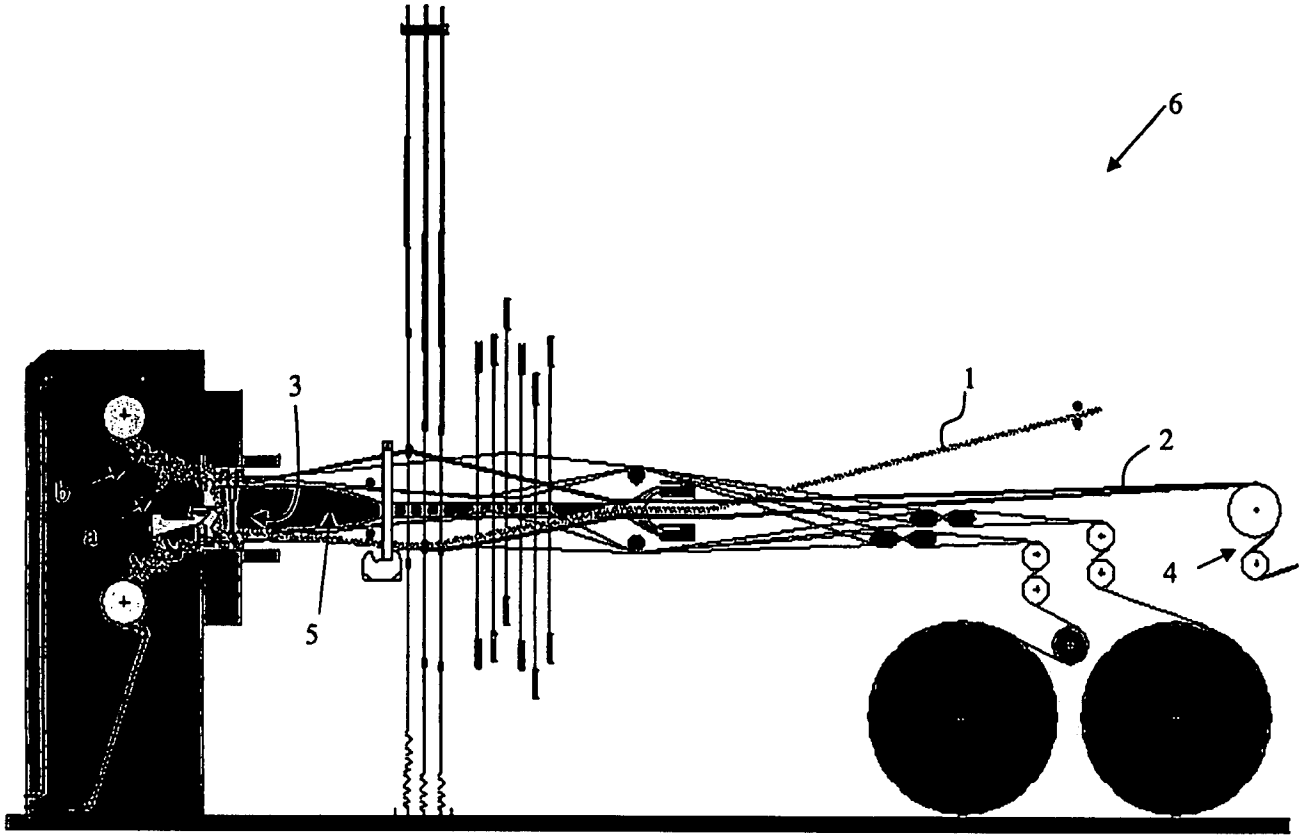
FIG. 1: is a schematic representation of a double-face weaving device according to the present invention and designed for the application of the method in accordance with this invention.
Figure 2:
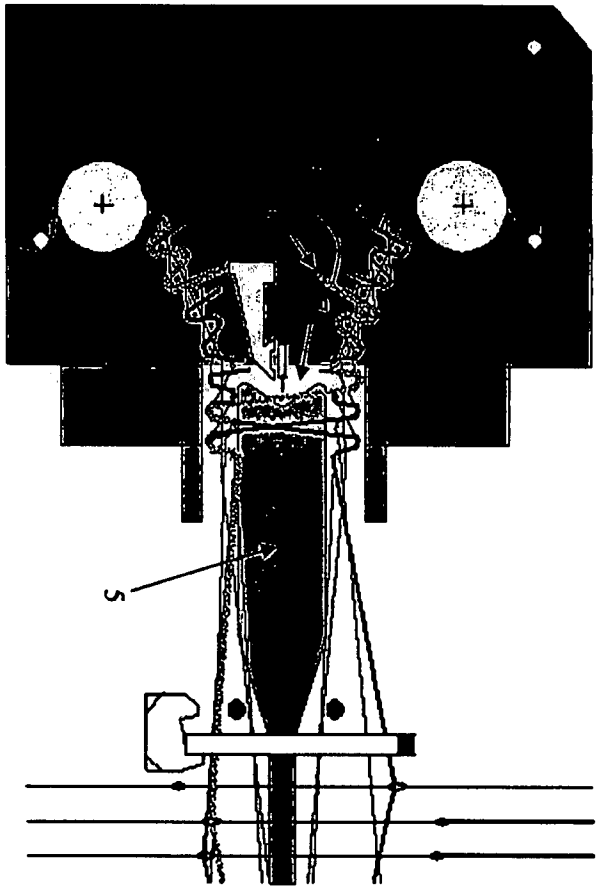
FIG. 2: is a side view of the double-face weaving device represented in FIG. 1.

In order to manufacture fabrics with at least two pile heights (a, b) in the same pile row, this invention provides, inter alia, a method which allows fabrics to be realized on single and double-face weaving devices with cut pile and/or loop pile in different pile height, with a free choice in terms of position and pile height of the zones with varying pile height. The method in accordance with the present invention relates, in particular, to a method for weaving pile fabrics with at least two different pile heights (a. b) in the same pile row, wherein the fabrics comprise weft threads, ground warp threads and pile-warp threads (1, 2), wherein these pile-warp threads (1, 2) are interlaced in the fabric, according to a pattern, in a figure-forming manner or are inwoven in a non-figure-forming manner, and which, when they are figure-forming, form pile with a well-defined pile height, wherein a first set of pile-warp threads (1) is inserted in such a way that these move virtually without strain or under light strain onward into the just formed fabric (3) and wherein at least a second set of pile-warp threads (2) is inserted in such a way that, in relation to the first set of pile-warp threads (1), they move with a higher strain onward into the just formed fabric (3).

The method in accordance with the invention can be used both in single-face and double-face weaving.

In double-face weaving, two pile fabrics are manufactured at the same time. A topmost and a bottommost ground fabric of warp threads (yarns) and weft threads (yarns) are formed, whilst pile-warp threads (1, 2) (yarns) are interlaced alternately in one and the other ground fabric. After this, the pile-warp threads (1, 2) are cut through between the two ground fabrics by means of a known cutting device, so that two ground fabrics are obtained, which each have a series of upright lengths of pile thread, also referred to as the pile. In the embodiments according to the prior art, the interspace between the topmost and bottommost ground fabric is determinant for the length of those parts of the pile-warp threads which run between the two ground fabrics, and thus also for the pile height thereof. During the double-face weaving, this interspace must be kept as constant as possible. In order to achieve this, on double-face weaving machines having two weft insertion levels, lancet devices are utilized. Here, in a lancet holder, a series of lancets are used, which lancets are distributed over the weaving width and extend in the warp direction between the warp systems and between the blades of the reed. These lancets then serve as spacers for keeping the two ground fabrics at a distance apart. The known lancets consist of an elongate metal strip with a small thickness (for example 0.1, 0.2, 0.3 or 0.4 mm) and with a height which is equal to the desired interspace between the two ground fabrics in double-face weaving, for example 3, 5, 8, 10, 15, 18, 20, 22, 24, 30 mm. For specific use with long-haired carpets, referred to as shaggy, and also in the weaving of artificial turf, even lancets of 50, 70, 100 to 140 mm height are known. One end is designed for reception in the lancet holder, whilst the other end ends in a point, with the point ending up above the bottommost cutting table of the weaving machine.

At the same time, the force upon the pile-warp thread yet to be inwoven is chosen such that, when the two ground fabrics are connected by means of the pile-warp threads, an approximate force equilibrium is formed between the forces resulting from the ground yarns, which for each ground fabric cause the ground fabric to be pulled away from each other, and the forces resulting from the pile yarns, which pull the ground fabrics towards each other. This ensures that the lancets sit virtually loose between the two not yet separated ground fabrics, or that the force upon the lancets, as a result of the ground fabrics which are bearing against them or are tensioned slightly against them, remains very limited, so that, when the woven pile fabric is moved forward into the machine, the lancets are not ripped off from the lancet holder.

In order now, on a double-face weaving device, to realize fabrics with cut pile and/or loop pile in different pile height (a, b), with a free choice in terms of position and pile height of the zones with differing pile height, the present invention also provides a method for weaving pile fabrics with at least two different pile heights (a, b) in the same pile row, wherein a bottommost and a topmost pile fabric are woven according to a double-face weaving method, wherein the fabrics comprise weft threads, ground warp threads and pile-warp threads (1, 2), wherein these pile-warp threads (1, 2) are alternately interlaced in the fabric, according to a pattern, in a figure-forming manner and are inwoven in a non-figure-forming manner, and which, when they are figure-forming, form pile with a well-defined pile height, wherein a first set of pile-warp threads (1) is inserted, which, in figuring application, is interlaced alternately in the bottommost and topmost pile fabric and which is designed to, after having been cut through, realize a first pile height (a) in both pile fabrics, and wherein at least a second set of pile-warp threads (2) is inserted, which, in figuring application, is interlaced alternately in the bottommost and topmost pile fabric and which is designed to, after having been cut through, realize a second pile height (b) in both pile fabrics.

To this end, the present invention sets out to provide the weaving device with means (4) with which, for at least a second set of pile-warp threads (2), the pile yarn length, measured in the unstrained state, which according to the weaving pattern is necessary in order to weave a double-face fabric with a defined externally measured height, can be reduced, so that the relevant pile-warp threads move forward under tension (in the stretched state) into the just formed double-face fabric (3) until, after the double-face fabric has been cut through, they assume their tension-free (unstrained) length from the binding point in the fabric. The (tension-free) length of the second set of pile-warp threads (the second pile height) will be smaller than the length of the first set of pile-warp threads (1), since these move forward without tension, or only under a slight tension, into the just formed double-face fabric, so that, after the double-face fabric has been cut through, they assume their length (first pile height). Within the scope of this patent application, the first pile height (a) should also be regarded as the maximum height of the pile in the bottommost and topmost fabric.

The lower the longitudinal stiffness of the pile-warp threads, the greater is the extent to which tension differences between pile-warp threads produce an unwanted difference in pile height; in this context, it becomes more interesting to provide means whereby a specific desired quantity (length) of pile-warp thread to be used is delivered.

Such means can be regarded, as it were, as a feed control device (4) for pile-warp threads. With such a device, the strain or tension in the set of pile-warp threads can be realized, so that these pile-warp threads can be inserted into the pile fabric in the stretched or tensioned state. As such means can be used:

- Rollers lined with anti-slip material, supplemented by reversing rollers in order to make the deflection angle around the rollers sufficiently large, wherein the movement of the rollers can be driven on the basis of the information of the weaving pattern, and by a mechanical connection to the weaving machine (via gears, clutches, belts, . . . ), by a combination of the above with an electromagnetically, pneumatically or hydraulically operated clutch, or by combination with a servo motor.
- Alternatively, a yarn beam can also be provided, the unwinding of which is controlled according to the desired yarn feed, which is determined according to the weave structure, with measurement or estimation of the current beam diameter.

In addition, consideration can be given to all other means, such as those known from tufting, which ensure a temporary tensioning or straining of a pile-warp thread (which is the same as limiting the feed of pile-warp thread measured in the tension-free state), so that the pile-warp thread moves under tension (in the stretched state) onward into the just formed double-face pile fabric, whereafter the pile-warp thread, after the double-face fabric has been cut, assumes its definitive length: such yarn tensioning systems are, for example:

- a system wherein the said pile-warp threads run over one or more eccentric discs and wherein, according to choice, according to the weaving pattern, the discs can be rotated to change the length of the yarn path;
- a system wherein the said pile-warp threads run in a distributed manner over a number of guides, which can be moved to and fro and which are driven with the aid of servo motors, so that, here too, the yarn path becomes longer or shorter;
- a system wherein the pile-warp threads run between laths which can be moved up to each other, wherein these laths have notches in which the pile-warp threads can be guided or not, so that a change in yarn path length happens or not. The movement of the laths can be driven either according to a fixed pattern or according to a programmable sequence;
- a system wherein the pile-warp threads run over rollers which, viewed over the longitudinal direction, are alternately lined and not lined with anti-slip bands, and wherein the pile yarns are guided by a guide system per weaving cycle either over the anti-slip band or over the unlined part. The movement of the guide system can be driven either according to a fixed pattern or according to a programmable sequence;
- a system wherein the pile yarns are individually forced by a controlled guide system against a slow-turning or a quick-turning roller, or not, whereby the yarn feed is momentarily affected according to a chosen pattern.

Finally, all pile-warp threads can be fed a defined length via means, wherein at least one set of the pile-warp threads is then fed a length which conforms to the length which is necessary to create a double-face fabric with a defined externally measured height, and wherein at least a second set of pile-warp threads is then fed a length which is not consistent with the length which is necessary to create a double-face fabric with a defined externally measured height, so that the pile-warp threads of this second set are woven in the tensioned (stretched) state into the double-face fabric, and wherein, where they are interlaced in a figure-forming manner, they are cut through at the cutting device and can at this place turn back from the binding point, according to their tension-free length, whereby a lower pile is created.

Within this at least second set of pile-warp threads, the pile-warp threads can still at different moments be figure-forming if the total yarn consumption according to the weave structure, viewed on average, is approximately the same for each of the pile-warp threads of this set, and if the consumption per pile-warp thread, viewed over a large number of weaving cycles, does not excessively vary, so that the elasticity of the threads can absorb this momentary difference, or the necessary buffer elements per momentarily same figure-forming group of pile-warp threads of this set are foreseen for this purpose.

In a preferred embodiment of the invention, during the weaving process for the said second set of pile-warp threads, continuously a smaller length is supplied than that which is required according to the weave structure to obtain the desired externally measured pile height of the pile fabric. A set of pile-warp threads is hereby obtained, which, if interlaced in a figure-forming manner, after having been cut through, will always have a lowered pile length in relation to the externally measured height of the pile fabric in which they are interlaced.

In a further preferred embodiment, different means are provided for different portions of the pile-warp threads, so that more than 2 different pile levels (pile heights) can be obtained.

This at least second set of pile-warp threads can consist, for example, of all pile-warp threads of 1 colour frame, so that, for all pile-warp systems, respectively 1 pile-warp thread thus has a reduced (yarn) supply, and thus, in figuring application, exhibits a lower level after the double-face fabric has been cut through.

For all methods according to the invention, a lancet (5) with a specific shape is preferably used, which lancet allows the wefts of the top and bottom portions of the double-face fabric to be kept at a desired distance apart, wherein the shape of the lancet enables the cutting knife to be positioned in such a way in relation to the lancet that the top and bottom fabric, at the moment of cutting, can still bear against the lancet or be tensioned against it. To this end, the lancet has a shape which differs from the lancets of the prior art. The portion which determines the distance between the two ground fabrics (and which thus has there a rigid connection between the top and bottom edge of the lancet) is longer, so that, following installation in the machine, it runs through further up to the height of the cutting device, and where, hitherto, a point shape was provided, there is here provided a channel (7) into which the cutting knife can move during its to-and-fro movement.

The above-described method relating to double-face weaving can also be used in the weaving of so-called 'loop pile' and cut-loop' pile fabrics, but in this case without the cutting of the loop-forming pile-warp threads (yarns), and consequently falls within the scope of this application. In such pile fabrics, from the ground fabrics with pile-warp threads, loops are formed over so-called lost wefts, which lie over known lancets and which are subsequently pulled out of the fabric. By limiting the supplied length (measured in the tension-free state) for a portion of the loop-forming pile-warp threads, these loops, after leaving the distancing lancets, will have a lesser height than the other loops whose supply of length has not been limited.

The invention likewise relates to a single-face weaving machine of the rod weaving machine type. The invention consists in providing means by which, for a portion of the pile-warp threads, preferably at least a second set of pile-warp threads, the length which according to the weaving pattern is necessary to weave a pile fabric with a defined height can be reduced, so that the relevant pile-warp threads move forward under increased tension into the just formed single-face fabric until, following the withdrawal of the rod, they assume their tension-free form from the binding point in the fabric.

The rod can both be a cutting rod and a conventional pull rod, so that both loops and cut pile with different heights can be created.

The extent to which the pile height differences arise is largely dependent on the difference in longitudinal stiffness of the various types of pile-warp threads which are used for these height effects.

The pile heights of the lower portions, after the double-face fabric has been cut through, can amount, for example, to about 90% of the height of the highest portion measured from the point where the pile yarn leaves the ground fabric in figuring application, but the lower the longitudinal stiffness of the pile yarn for the lower portion, or the higher the associated tension on this pile yarn, the lower is the pile height of the fabric part formed with this pile yarn. Hence the pile height can fall, for example, to 70%, to 50%, or even to 20 to 30% of the pile height of the highest portion.

Such a method can be used to produce artificial turf, wherein a damping effect is realized to a greater or lesser extent by means of elastic yarns with a damping capability, which yarns are woven in the stretched state, so that, after the double-face fabric has been cut through, they spring back into their unstretched state. These elastic yarns (for example elastomers) can be stretched, for example, 2 to 3.5 times more in relation to the pile yarns, so that they have inwoven elastic yarns, which, after the double-face fabric has been cut through, have a second pile height of 10 to 20 mm, whilst the other, normal yarns, constituting the artificial turf itself, have a first pile height of 20 to 70 mm.

The invention claimed is:

1. Method for weaving pile fabrics with at least two different pile heights (a, b) in the same pile row, wherein weaving the fabrics comprises providing weft threads, ground warp threads and pile-warp threads, interlacing the pile-warp threads in the fabrics, according to a pattern, in a figure-forming manner, and which, when the pile-warp threads are figure-forming, form pile with a well-defined pile height difference (a, b), inserting a first set of the pile-warp threads (1) in such a way that these move virtually with no or light strain, onward into the just formed fabric (3), and inserting at least a second set of the pile-warp threads (2) in such a way that, in relation to the first set of the pile-warp threads (1), the second set of the pile-warp threads move with a higher strain onward into the just formed fabric (3).

2. Method for weaving pile fabrics according to claim 1, wherein, the providing the pile-warp threads comprises providing the first set of pile-warp threads (1) and the at least second set of pile-warp threads (2), with apart from the strain the same characteristics.

3. Method for weaving pile fabrics according to claim 1, wherein the pile-warp threads of the at least second set of pile-warp threads (2) have apart from the strain other characteristics than the pile-warp threads of the first set of pile-warp threads.

4. Method for weaving pile fabrics according to claim 1, wherein the inserting comprises feeding the at least second set of pile-warp threads (2), in relation to the first set of pile-warp threads (1), with a higher strain into to the fabric (3) to be formed.

5. Method for weaving pile fabrics according to claim 4, wherein the feeding the at least second set of pile-warp threads (2) to the fabric (3) to be formed further comprising providing a feed control device (4) for pile-warp threads.

6. Method for weaving pile fabrics according to claim 1, wherein the pile fabrics are woven on a single-face weaving machine.

7. Method for weaving pile fabrics according to claim 1, further comprising weaving a bottommost pile fabric and a topmost pile fabric according to a double-face weaving method, interlacing the pile-warp threads (1, 2) comprises interlacing the pile-warp threads alternately in the bottommost pile fabric and topmost pile fabric, separating the fabrics by cutting through the figure-forming pile-warp threads, after having been cut through, realizing in each pile fabric a first pile height (a), and a second pile height (b).

8. Method for weaving pile fabrics according to claim 7, further comprising providing a double-face weaving machine with a lancet device having one or more lancets, and cutting through all figure-forming pile-warp threads are cut through at a channel in the lancets.

9. Weaving machine for the weaving of pile fabrics comprising at least two different pile heights (a, b) in the same pile row, wherein the said fabrics comprise weft threads, ground warp threads and pile-warp threads (1, 2), and wherein these pile-warp threads (1, 2) are interlaced in the fabric, according to a pattern, in a figure-forming manner and which, when they are figure-forming, form pile with a well-defined pile height (a, b), wherein the weaving machine comprises first means designed to introduce a first set of pile-warp threads in such a way that they will move, with no or slight strain, onward into the fabric to be formed, and in that the weaving machine further comprises at least second means (4), designed to introduce at least a second set of pile-warp threads (2) in such a way that, in relation to the first set of pile-warp threads (1), the second set of pile-warp threads will move with a higher strain onward into the fabric to be formed.

10. Weaving machine for the weaving of pile fabrics according to claim 9, wherein the said weaving machine is a double-face weaving machine (6) for the double-face weaving of a top and bottom fabrics comprising at least two different pile heights (a, b) in the same pile row.

* * * * *